US005473580A

United States Patent [19]

Gilomen et al.

[11] Patent Number: 5,473,580

[45] Date of Patent: Dec. 5, 1995

[54] CHRONOGRAPH WATCH WITH DATE INDICATOR

[75] Inventors: Beat Gilomen, Grenchen; Clement Meyrat, LeLanderon, both of Switzerland

[73] Assignee: ETA SA Fabrique d'Ebauches, Grenchen, Switzerland

[21] Appl. No.: 216,524

[22] Filed: Mar. 23, 1994

[30] Foreign Application Priority Data

Mar. 23, 1993 [CH] Switzerland ..... 00881/93

[51] Int. Cl.[6] ..... G04B 19/24; G04B 19/04; G04F 8/00

[52] U.S. Cl. ..... 368/28; 368/80; 368/110

[58] Field of Search ..... 368/28, 35–38, 368/76, 80, 107–113

[56] References Cited

U.S. PATENT DOCUMENTS

| | | | |
|---|---|---|---|
| 4,972,393 | 11/1990 | Sase et al. | 368/28 |
| 4,974,242 | 11/1990 | Vuilleumier | 368/37 |
| 5,184,333 | 2/1993 | Caspar | 368/28 |
| 5,282,179 | 1/1994 | Vuilleumier | 368/28 |

FOREIGN PATENT DOCUMENTS

| | | |
|---|---|---|
| 0027250 | 4/1981 | European Pat. Off. . |
| 0231451 | 8/1987 | European Pat. Off. . |
| 0493613 | 7/1992 | European Pat. Off. . |
| 0502292 | 9/1992 | European Pat. Off. . |
| 2404250 | 4/1979 | France . |
| 2605118 | 4/1988 | France . |

*Primary Examiner*—Vit W. Miska
*Attorney, Agent, or Firm*—Weil, Gotshal & Manges

[57] ABSTRACT

A chronograph watch comprises time keeping first indicators (H, M, S1) used for displaying the time of day and chronograph second indicators (h, m, S2) used for displaying an interval of time in response to a control arrangement (P1, P2) with the aid of which the chronograph can be started, stopped and reset to zero. The chronograph watch includes instantaneous conversion means for at least one of the second indicators (here the seconds counter S2) into an indicator of another function, for example an indication of the date (Q), when the chronograph is not in use. In such example there is also provided the transformation of the minutes counter (m) into a four-year cycle indicator (BISS) and the hours counter (h) into a months indicator (Mo).

11 Claims, 7 Drawing Sheets

CHRONOGRAPH WATCH WITH DATE INDICATOR

The present invention relates to a chronograph watch comprising time keeping first indicators used to display the time of day and chronograph second indicators used to display a time interval responsive to a manual control arrangement with which the chronograph can be started, stopped, then reset to zero.

BACKGROUND OF THE INVENTION

A chronograph watch responding to the generic definition which has just been given is shown for example in the patent EP-A-0 048 217. The time keeping portion of such chronograph watch includes hours, minutes and small seconds hands as well as the date display appearing in a window. Such time keeping portion is driven by one of two stepping motors with which the watch calibre is furnished. The chronograph portion includes a large center seconds hand, a minutes counter and an hours counter, such chronograph portion being driven by the other of the two stepping motors. Here the use of two motors controlled by different frequencies has as purpose to economize energy in a manner such that the chronograph watch has an operating autonomy almost as long as that of a standard watch not comprising a chronograph function.

A watch, also including two motors, is described in the patent EP-0 059 164 (U.S. Pat. No. 4,398,832). This watch includes a first motor driving the seconds hand in a manner entirely independent from the minutes and hours hands, themselves driven by a second motor. A logic circuit enables controlling the first motor in response to control elements external or internal to the electronic circuit of the watch and in response to time base signals furnished by a frequency divider in a manner such that the seconds hand displays information other than that of the second.

SUMMARY OF THE INVENTION

The combination of the two documents cited hereinabove in no manner suggests a chronograph watch including instantaneous conversion means of at least one of the chronograph indicators into an indicator of another function, in particular a time function such as the date whenever said chronograph is not in use, this particularity constituting the basic characteristic of the present invention.

The invention is now about to be explained by means of the examples shown by the drawings.

DESCRIPTION OF THE PREFERRED EMBODIMENTS

Figure 1:
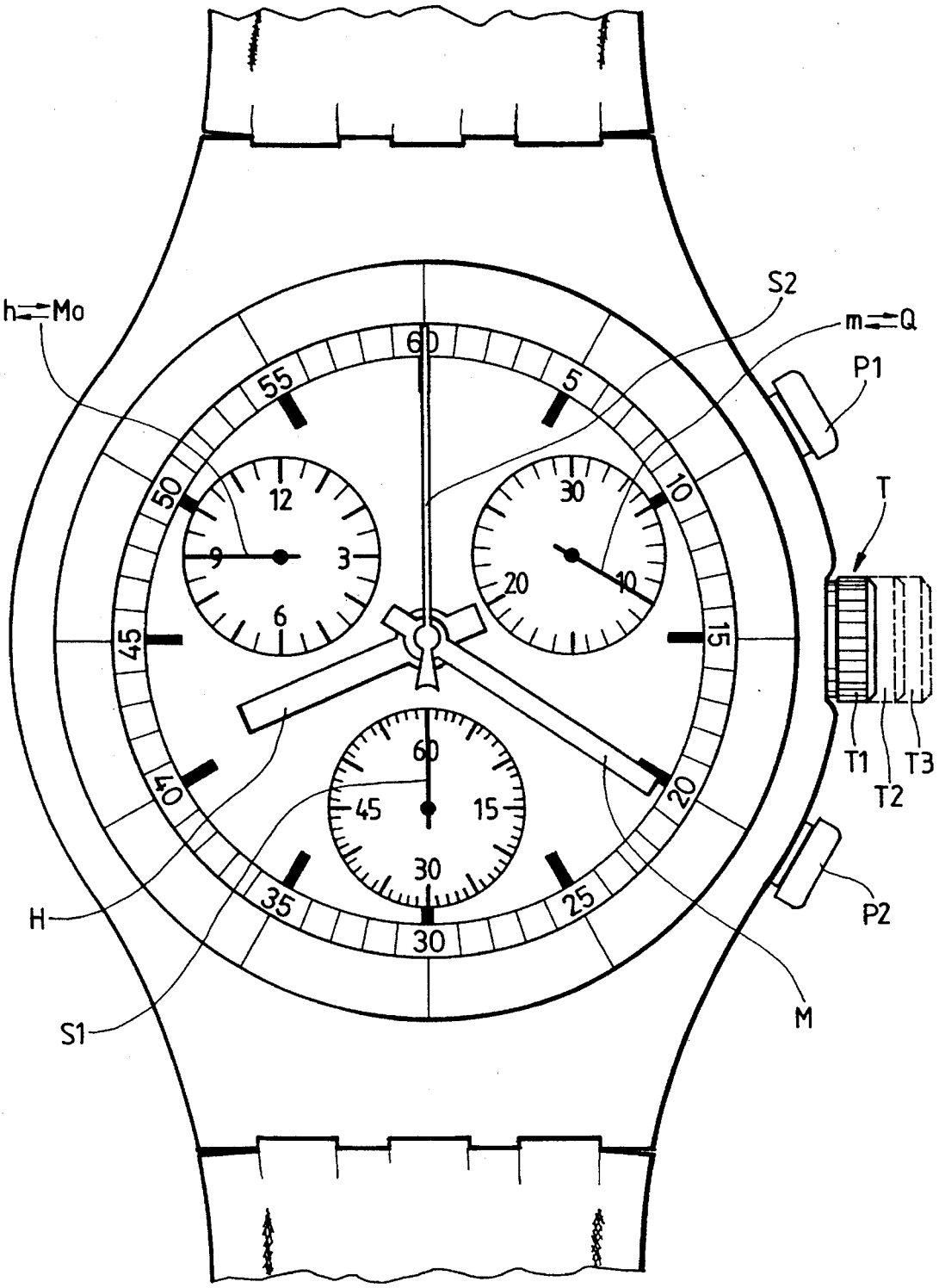
FIG. 1 is a plan view of the chronograph watch according to a first embodiment of the invention.

The chronograph watch of FIG. 1 exhibits a first embodiment of the invention. It includes time keeping first indicators in order to display the time of day, in this case, an hours hand H, a minutes hand M and a small seconds hand S1. Such hands are coupled together by a mechanical dial train, the small seconds hand generally being driven directly by the rotor spindle of a first stepping motor. The chronograph watch also includes chronograph second indicators in order to display a time interval, in this case a large hand S2 in order to count seconds, a first small hand m in order to count minutes and a second small hand h for counting hours. A second stepping motor drives the large hand S2, a third stepping motor drives the first small hand m and a fourth stepping motor drives the second small hand h. A manual control arrangement including two push-pieces P1 and P2 enables starting, stopping, then resetting to zero the chronograph indicators S2, m and h. Very generally, according to the invention, the chronograph watch includes instantaneous conversion means of at least one of said second indicators S2, m and h into a date indicator Q when the chronograph is not in use. In the specific case of FIG. 1, it is the first small hand m counting the chronograph minutes which is converted into a date indicator Q from whence m→Q when the chronograph is not in use. In order to complete the time keeping indications, it is also possible to convert the second small hand h counting chronograph hours into a month indicator Mo, from whence h→Mo when the chronograph is not in use.

FIG. 1 shows that the first small hand m counting minutes rotates over a dial including 30 divisions. It makes one revolution in thirty minutes. In the same manner, the second small hand h counting hours rotates over a dial including 24 divisions. It makes one revolution in 12 hours. When the hand m has made a revolution, hand h advances through one division and indicates an additional half-hour.

When the first small hand m is converted into a date indicator Q, it progresses through one division per day and when the second small hand H is converted into a month indicator Mo, it advances two divisions per month. In the case in which the month includes 31 days, the watch is programmed (see further on) in order that the indicator Q remains for two days on division 30. In the case of a month of February having 28 days, the watch is programmed in order that the indicator Q jumps from the division 28 to the division 1 at the end of the 28th day. If the watch is also programmed for leap years, the indicator Q jumps from division 29 to division 1 at the end of the 29th day of the month of February.

The chronograph is started by actuating push-piece P1. From this instant the date indicator Q is set to zero (division 30 of FIG. 1) and begins to count minutes m. There is then found the conversion m←Q indicated on the figure. In an analogous manner, when push-piece P1 is actuated, the month indicator Mo is set to zero (division 12 of FIG. 1) and begins to count hours h. There is then found the conversion h←Mo indicated on the figure. When the chronograph is stopped by a further actuation of push-piece P1, the first m and second h small hands continue to indicate the elapsed time in minutes and hours respectively.

Beginning with the stopped state, the chronograph is reset to zero by actuating push-piece P2. From this moment on, the chronograph no longer being in use, the first small hand m→Q is then instantaneously positioned on the date and the second small hand h→Mo is then instantaneously positioned on the month. The large hand S2 is brought to 60 and remains set there. In the example of FIG. 1, the first and second small hands display 10 minutes and 9 hours (elapsed time) or the 10th of September (timepiece) according to whether said hands display a time interval or the day and month respectively.

The first embodiment of the invention which has just been partially described has the advantage of exhibiting the same dial layout, whatever be the functions which are attributed to the first and second small hands. It however shows the drawback of allowing an ambiguity to subsist as to whether one is on the 30th or the 31st of a month including 31 days.

FIG. 1 further shows that the chronograph watch comprises a stem-crown T which can be brought into three different axial positions: a pushed-in or rest position T1, a first drawn-out position T2 and a second drawn-out position T3. When the crown is brought into the second drawn-out position T3, it is possible to proceed with manual time setting of the time keeper hands H and M by rotation of said crown. In position T3, the small seconds hand S1 is blocked, which enables setting the time keeper to the second of the time signal.

Figure 2:
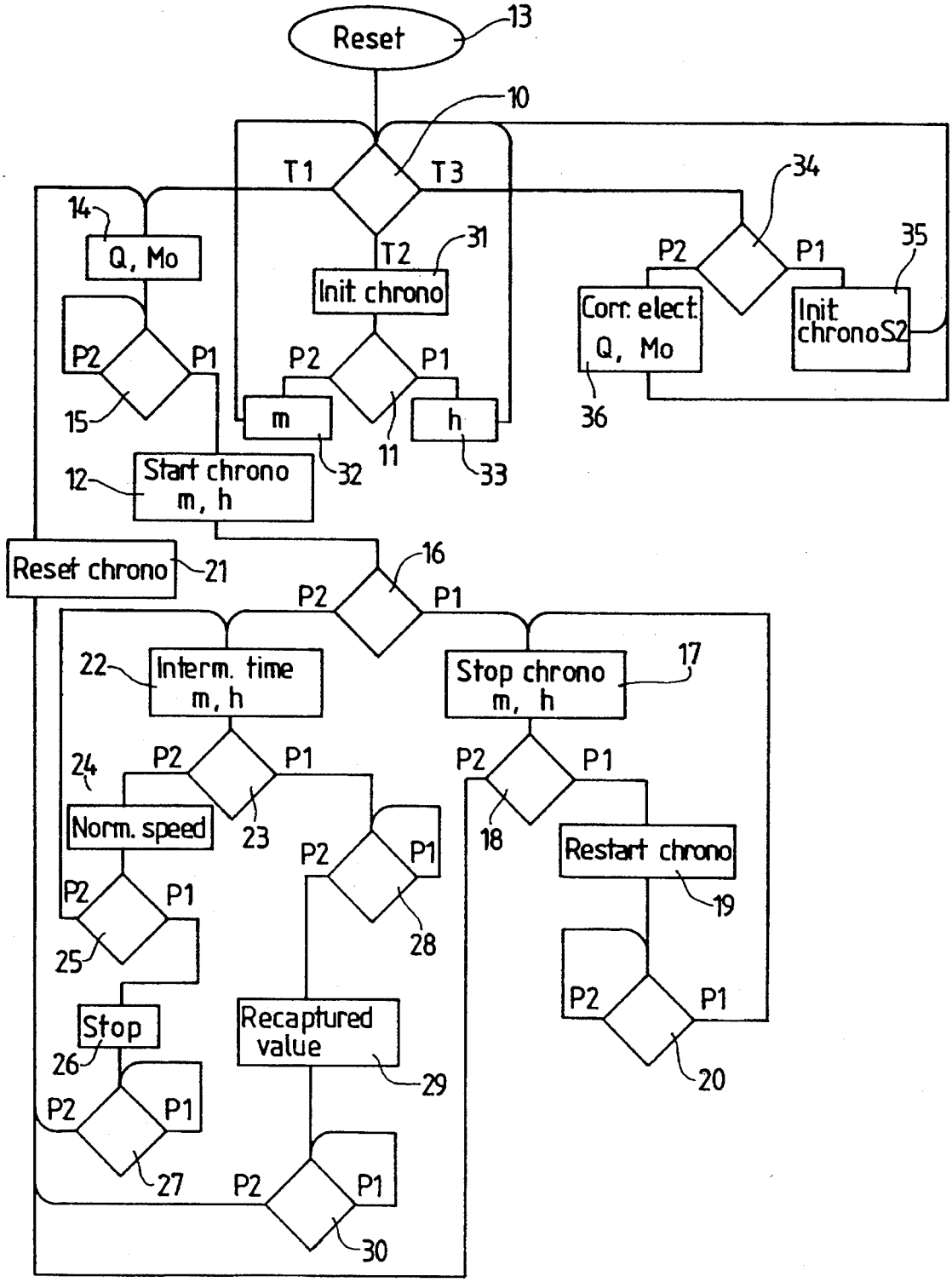
FIG. 2 is a flow chart explaining the functions of the stem-crown and the push-pieces of the chronograph watch.

Reference will now be had to FIG. 2 which is a flow chart explaining the functions of the stem-crown T and the push-pieces P1 and P2 fitting out the chronograph watch. In this flow chart, a diamond form indicates a choice made by the watch user, for example to set the crown into position T1 or T2 or T3 (diamond 10), as further example press on push-piece P1 or push-piece P2 (diamond 11). A rectangle indicates in which mode the watch is found after having made a choice, for example starting the chronograph (rectangle 12) after having pressed push-piece P1 (choice 15).

At the start it is assumed that the chronograph is not in use or that it has been reset to zero (reset 13). If the crown is in the pushed-in position T1, the first and second small hands indicate respectively the date Q and the month Mo (mode 14). If the push-piece P1 is actuated (choice 15), the chronograph is started (mode 12) and the first and second small hands indicate respectively chronograph minutes m and hours h. Starting from mode 12, if push-piece P1 is pressed (choice 16), the chronograph is stopped (mode 17) and the first and second small hands continue to indicate respectively chronograph minutes m and hours h. Starting from mode 17, if push-piece P1 is pressed (choice 18) the chronograph is restarted (mode 19) which can be once again stopped (mode 17) if push-piece P1 is pressed (choice 20). Starting from mode 17, if push-piece P2 is pressed, the chronograph is reset to zero (mode 21), which has as consequence the instantaneous indication of the date Q and month Mo (mode 14) by the respective first and second small hands.

Starting now from mode 12 (chronograph operating), if push-piece P2 is pressed (choice 16), there is obtained an intermediate time (mode 22), the first and second small hands being stopped and indicating respectively the minutes m and hours h of this intermediate time. Starting from such mode 22, if the push-piece P2 is pressed again (choice 23), the first and second small hands m and h (as moreover the large hand S2) initially advance at high speed to catch up with the present time from the moment at which such hands have been stopped at the intermediate time, then at normal chronograph speed (mode 24). If once again it is desired to obtain an intermediate time, push-piece P will once again be pressed (choice 25). Starting from mode 24, if push-piece P1 is pressed, the chronograph is stopped (mode 26). If push-piece P2 is pressed starting from mode 26 (choice 27), the chronograph is reset to zero (mode 21), which has as consequence the instantaneous indication of the date Q and month Mo (mode 14) by the respective first and second small hands. If now one returns to choice 23 and push-piece P1 is pressed, then push-piece P2 (choice 28), the time is made up and blocked at the recaptured value (mode 29) from which pressure on push-piece P2 (choice 30) resets the chronograph to zero (mode 21) and instantaneously places the first and second small hands, respectively on the date indication Q and month Mo (mode 14)

The chronograph watch is provided with means for initializing the chronograph second indicators S2, m and h, that is to say, returning such indicators to zero, for example following a power cell change or a shock applied to the watch. In placing crown T in the first drawn-out position T2, the initialization mode 31 is entered. In pressing on push-piece P2 (choice 11), the first small hand m is caused to rotate (mode 32) until it is positioned on division 30 of the dial of the minutes counter. In pressing on push-piece P1, the second small hand h is caused to rotate until it is positioned on division 12 of the dial of the hours counter (mode 33). In placing crown T in the second drawn-out position T3 and pressing on push-piece P1 (choice 34) entry is made into the initialization mode 35 of the large chronograph hand S2 which is reset to zero by actuating push-piece P1.

The operations which have been explained in the last two paragraphs hereinabove are a reminder of the manipulations to be exerted on the chronograph calibre N° 251.282 placed on the market by the applicant these latter years. They thus exhibit no novel characteristic.

It is found however that to arrange crown T in the second withdrawn position T3 and to press on push-piece P2 (choice 34) causes the chronograph watch to enter a mode 36 which is not used in the calibre cited hereinabove, but which will be beneficially used in the chronograph watch of this invention for setting the date Q and the month Mo. The setting of the date and the month are effected after the chronograph indicators have been reset to zero. From this point if pressure is exerted in a continuous manner on push-piece P2, the stem being placed in position T3, the first small hand Q advances likewise in a continuous manner causing advance by a month of the second small hand Mo each time that said first small hand will have run through one rotation over the dial. The watch is programmed in a manner such that at the end of each specific month, December, January, February, March, etc. the first small hand Q indicates respectively 31 (twice on 30), once again 31, then 28, then again 31, etc. Once the date and the month have been found, the pressure on push-piece P2 is relaxed and the first and second small hands will indicate the date and the exact month. In the case in which the watch is also programmed to indicate the month of February with 29 days, it will be observed what happens at the end of the month of February. For example, if the year in which the date is set is a leap year and one is in the month of March, for instance, the month indicator Mo will be made to advance as many times as it is necessary until the date indicator Q indicates the number 29, the month indicator showing the month of February. One proceeds in an analogous manner if one is in a pre-leap year.

Figure 3:
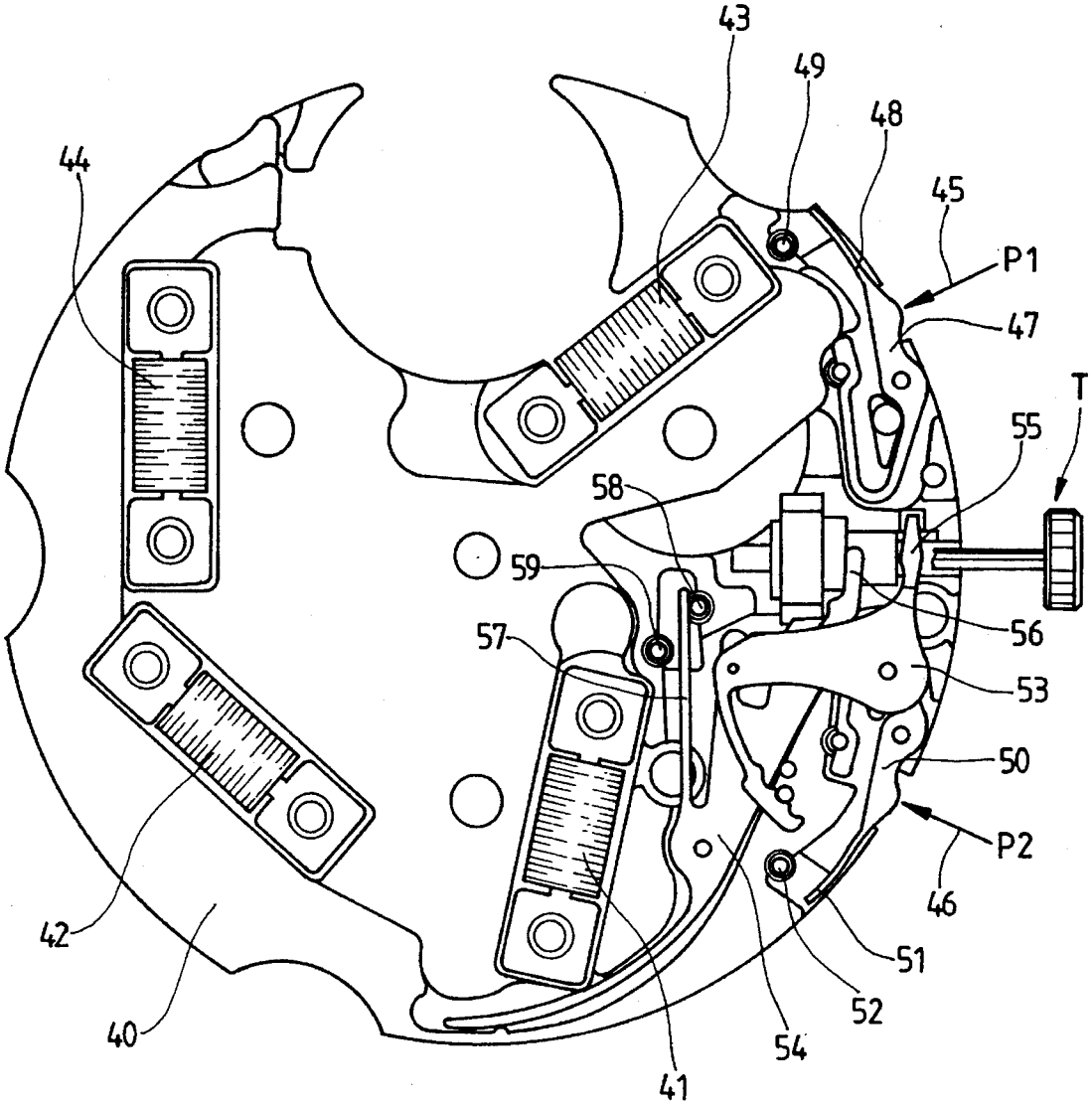
FIG. 3 is a top view of the assembled electric module such as it appears under the dial of the chronograph watch of FIG. 1.

FIG. 3 is a view from above of the assembled electric module 40 such as it appears under the dial of the chronograph watch of FIG. 1. It is seen that the module bears, in addition to the tracks of the printed circuit, not shown, in particular the driving motors, here indicated by their winding portion, and electrical switches. Motor 41 drives the small seconds hand S1 as well as the hours and minutes hands which are kinematically coupled thereto. The large hand S2 is driven by the motor 42 and the first and second small hands are respectively driven by the third 43 and the fourth 44 motors. The first push-piece P1 is symbolized by the arrow 45 and acts on a spring blade 47 set to a potential Vdd. When pressure is exerted on the blade, a tongue 48 of such blade is brought to place a rivet 49 at the same potential Vdd coupled electrically to the electronic circuit of the watch. The same arrangement exists for the second push-piece P2 symbolized by arrow 46 which acts on a spring blade 50 set to potential Vdd. When one bears on the blade, a tongue 51 of such blade is brought to place a rivet 52 electrically coupled to the electronic circuit of the watch to the same potential Vdd.

The module of FIG. 3 further bears a known trigger piece system 53 and lever 54. The nose 55 of the trigger piece is engaged in a groove of the stem (not shown) and the nose 56 of the lever is engaged in a groove of a sliding pinion (not shown). Stem T here is shown schematically and the lever, set to the potential Vdd, exhibits a tail 57 which comes into contact with rivet 58 when the stem T is in the first drawn-out position T2 and with the rivet 59 when the stem T is in the second drawn-out position T3. When stem T is in the pushed-in position T1, the tail piece 57 is located between rivets 58 and 59. Such rivets are electrically coupled to the electronic circuit of the watch and are found connected to the potential Vdd when there is a contact with the tail 57.

Figure 4:
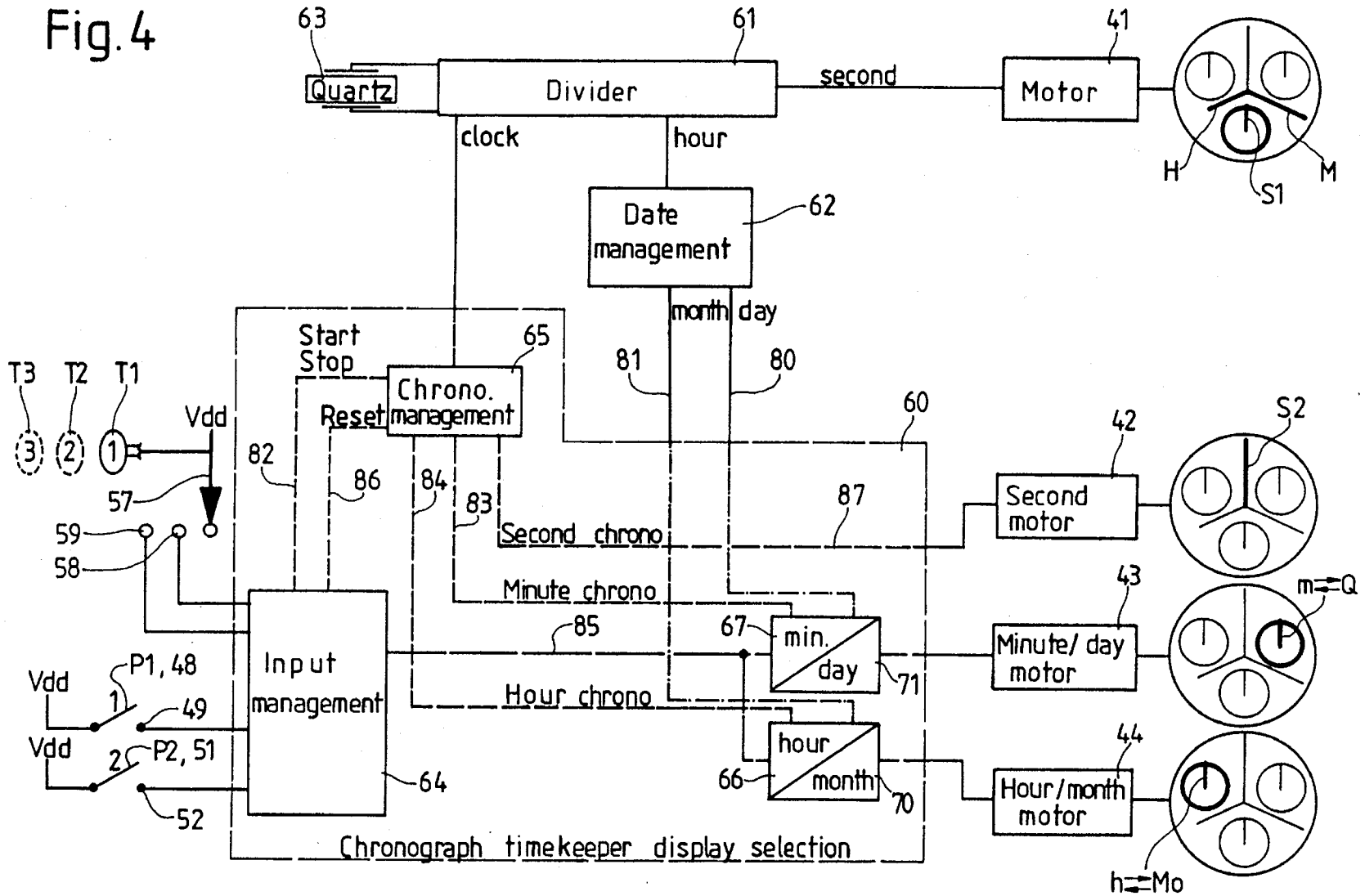
FIG. 4 is a schematic block showing the electric-electronic portion of the chronograph watch shown by FIG. 1.

FIG. 4 is a block schematic diagram exhibiting the electric-electronic portion of the chronograph watch shown on FIG. 1. This schematic principally includes a chronograph/timekeeper display selection block 60, a frequency divider 61 and a block 62 for managing the date according to the number of days in a month under consideration. Blocks 60, 61 and 62 form part of a micro-controller known under the reference OKI 5052. To such micro-controller are connected on the one hand the stem contacts 58, 59 and the push-piece contacts 49, 52 and on the other hand the four motors 41 to 44. A quartz time base 63 is connected to the input of the divider portion 61 of the micro-controller. The display selection block further includes a block 64 for managing the stem push-piece entries, a chronograph management block 65 and at least two counter/memories 66, 70 and 67, 71. The micro-controller is programmed in order to function in the following manner:

When the chronograph is not in use, the memories for days 71 and months 70 incremented by lines 80 and 81 coming from divider 61, display their contents via motors 43 and 44 on the first and second small hands, respectively Q and Mo. The timekeeper displays the second S1, the minute M and the hours H by the seconds output of the divider 61 via motor 41. The large hand S2 of the chronograph is at zero and the motor 42 is not activated. The hour signal coming from divider 61 controls the management block for the date 62 which attributes to each month the corresponding number of days. In the case in which the month includes 31 days, block 62 is arranged so as not to increase memory 71 during passage of the 30th to the 31st day in a manner such that the first small hand Q remains two days on division 30 of the dial (FIG. 1). In the case in which the month includes 28 days, the same block 61 is arranged so as to increment memory 71 by three additional steps at the end of the 28th day. In the case in which the month includes 29 days, it is necessary to manually update the calendar, this embodiment taken as an example not including the four-year cycle memory.

When the chronograph is started by push-piece P1 or stopped by push-piece P2, the management block for inputs 64 delivers a start or stop signal by line 82 to the chronograph management block 65 which, in the case of a start signal, enables incrementation of the minutes 67 and hours counters 66 by lines 83 and 84. Motors 43 and 44, controlled by counters 67 and 66 drive the first and second small hands m and h. Parallel thereto, block 64, by line 85, effects the transformations m←Q and h←Mo and maintains in memory the day and the month associated with the timekeeper.

When the chronograph is reset to zero by pressure on push-piece P2, the signal sent by line 86 (reset) to block 65 enables setting to zero on the one hand of the large hand S2 by line 87 and on the other hand the minutes 67 and hours 66 counters. In parallel thereto, motors 43 and 44 are switched onto memories 71 and 70 by line 85 and the transformations m→Q and h→Mo are effected.

Figure 5:
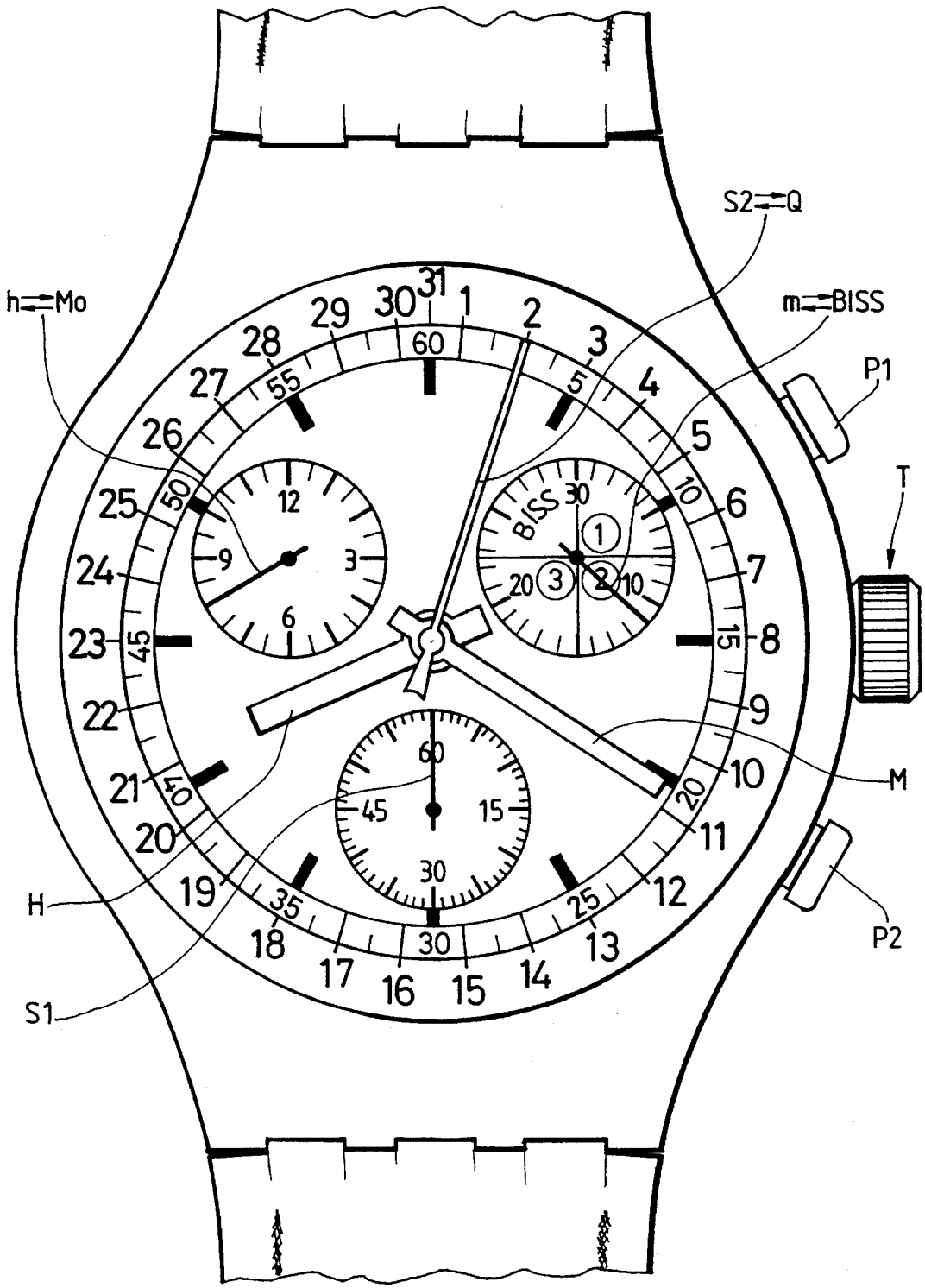
FIG. 5 is a plan view of the chronograph watch according to a second embodiment of the invention.

FIG. 5 is a plan view of the chronograph watch according to a second embodiment of the invention. As in the case of the first embodiment, it includes timekeeping first indicators for displaying the time of day, namely an hours hand H, a minutes hand M and a small seconds hand S1. Such hands are coupled together by a mechanical dial train, the small seconds hand being generally driven directly by the spindle of the rotor of a first stepping motor. The chronograph watch also includes chronograph second indicators in order to display a time interval, namely a large hand S2 to count seconds, a first small hand m in order to count minutes and a second small hand h for counting hours. A second stepping motor drives the large hand S2, a third stepping motor drives the first small hand m and a fourth stepping motor drives the second small hand h. A manual control arrangement including two push-pieces P1 and P2 enables starting, stopping, then resetting to zero the chronograph indicators S2, m and h. Very generally according to the invention, the chronograph watch includes instantaneous conversion means for at least one of said second indicators S2, m and h into a date indicator Q when the chronograph is not in use. In the specific case of FIG. 5, this is the large hand S2 counting chronograph seconds which is converted into a date indicator Q, from whence S2→Q when the chronograph is not in use. In order to complete the timekeeping indications, it is also possible to convert on the one hand the second small hand counting chronograph hours h into a month indicator Mo, from whence h→Mo and, on the other hand, the first small hand counting chronograph minutes m into a four-year leap year cycle BISS, from whence m→ BISS.

FIG. 5 shows that the large hand S2 counting seconds rotates over a dial including 60 divisions. It makes one rotation in one minute. Likewise, the first small hand m counting minutes rotates over a dial including 30 divisions, and the second small hand h counting hours rotates over a dial including 24 divisions. It makes one revolution in 12 hours. When hand S2 has made one revolution, the minutes hand m advances by one division and indicates one additional minute. When the hand m has made one rotation, hand h advances by a division and indicates an additional half-hour.

When the large hand S2 is converted into a date indicator Q, it advances by two divisions per day, except during the passages from the 30th to the 31st and from the 31st to the 1st day of the following month in which it advances only through one division. When the first small hand m is converted into a four-year cycle indicator BISS, it advances by 90° per year in order to indicate successively the first 1, second 2 and third 3 pre-leap years, then the leap year BISS. Finally, when the second small hand h is converted into a month indicator Mo, it advances by two divisions per month. This embodiment is provided with a perpetual calendar and when the large hand displays a month including 28, 29 or 30 days, such hand jumps to the 1st of the following month at the end of the 28th, 29th or 30th day.

As in the case of the chronograph watch of FIG. 1, the chronograph of FIG. 5 is started and stopped by pressure on push-piece P1. At the start, one then finds the conversion S2←Q, m←BISS and h→Mo. In actuating push-piece P2, the chronograph is reset to zero. From this instant, the large hand is instantaneously positioned on the date S2→Q, the first small hand is positioned instantaneously on one of the four years of the four-year cycle m→BISS and the second small hand is instantaneously positioned on the month h→Mo. In the example of FIG. 5, the large hand and the first and second small hands display 8 hours (h), 11 minutes (m) and 2 seconds (S2) of the measured time, or the 2nd (Q) August (Mo) of the second year (BISS) of the four-year cycle of the timekeeper according to whether such hands display a time interval or the time of day respectively. Finally, the stem-crown T of FIG. 5 has the same functions as those described with reference to FIG. 1.

This second embodiment requires, as is seen on FIG. 5, the providing of a special dial wherein, beside the seconds indication S2, minutes indication m and hours h appear respectively the date indications Q, the four-year cycle BISS and the month Mo. This special execution nevertheless exhibits the advantage of giving an exact reading of the last day of the month, whatever may be such last day.

The functions effected by stem T and the push-pieces P1 and P2 are the same as those shown in FIG. 2 and set forth hereinabove. They will not therefore be further reverted to here. It will be recalled however that the setting of date Q, month Mo and the year BISS is brought about in placing crown T in position T3 as shown on FIG. 1. If one then presses in a continuous manner on push-piece P2, the large hand Q rotates in a continuous manner and causes advancement by a month of the second small hand Mo each time that said large hand will have run through a rotation of the dial. When the second small hand Mo has effected one revolution, the four-year cycle indicator will jump a year. The time setting of such indicators consists thus in positioning initially the first small hand BISS on the year which is appropriate, then the second small hand Mo on the month and finally the large hand Q on the day.

The assembled electric module which fits out the chronograph watch of FIG. 5 is identical to that shown on FIG. 3. There likewise it is not necessary to revert to it further.

Figure 6:
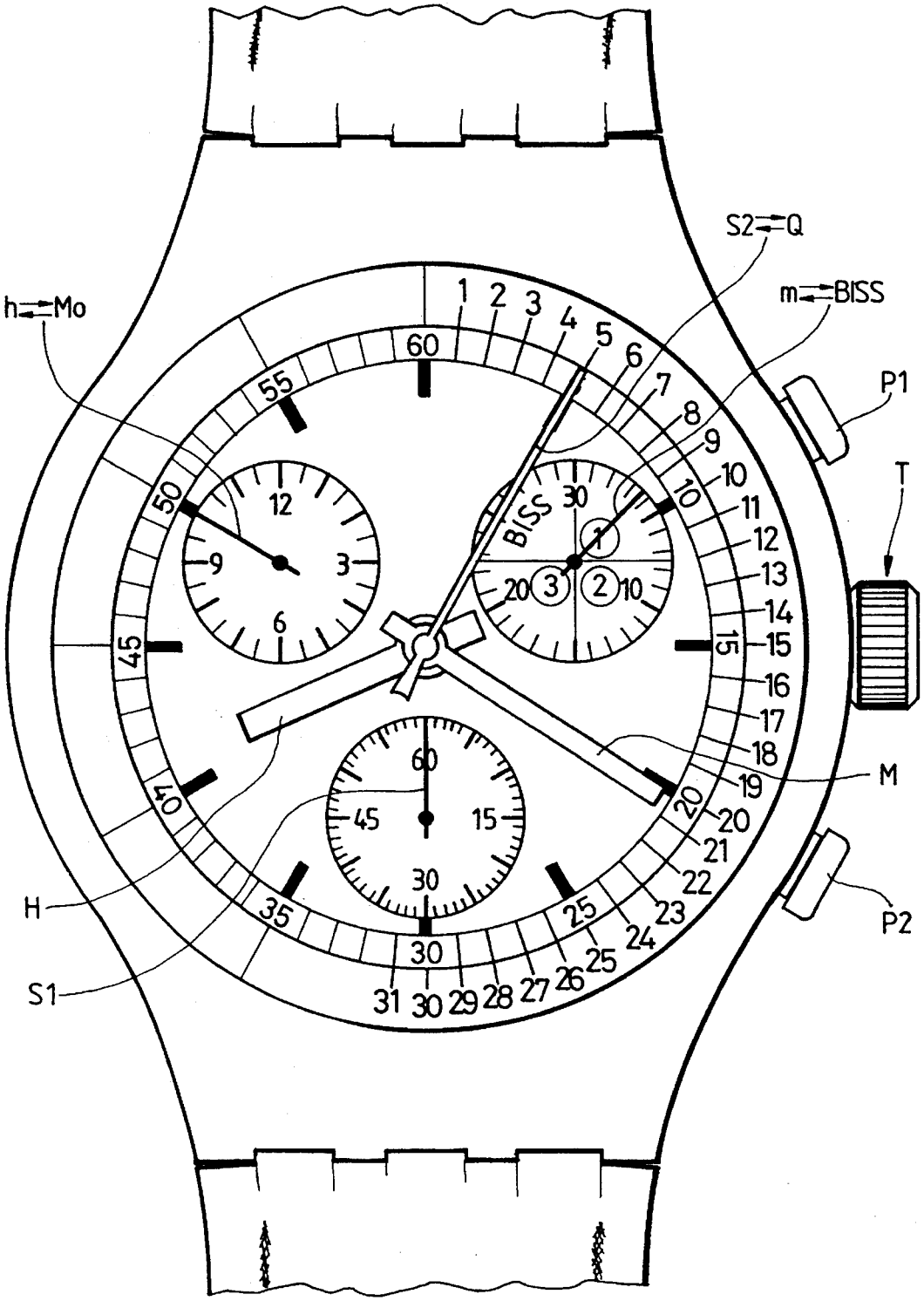
FIG. 6 is a variant of the embodiment shown in FIG. 5.

FIG. 6 is a variant of the second embodiment of the invention shown on FIG. 5. Such figures are different from one another only in the distribution of the date on the hours circle. In FIG. 6, the date divisions extend over 180° and have been separated in order to correspond to the seconds division of the chronograph. At the end of the last day of the month, the large hand Q advances rapidly over the remaining 180° so as to be brought into position on the first day of the following month. In FIG. 5, the date divisions extend over 360° with compression of the scale of the last two days of the month, as has already been mentioned hereinabove.

Figure 7:
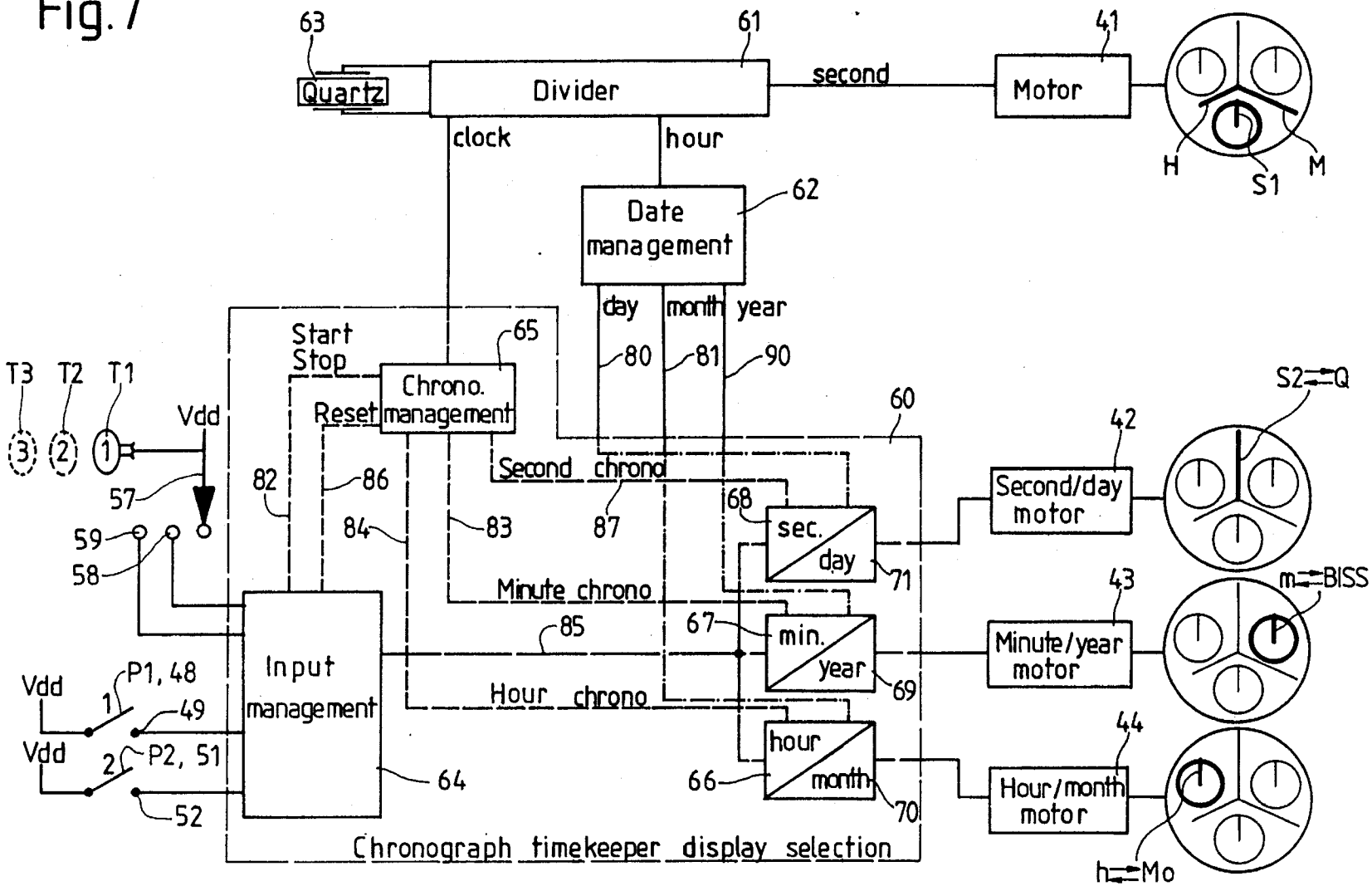
FIG. 7 is a block schematic showing the electric-electronic portion of the watches shown on FIGS. 5 and 6.

FIG. 7 is a block schematic showing the electricelectronic portion of the assembled chronograph watches shown on FIGS. 5 and 6. This schematic differs from that of FIG. 4 only in that it includes a supplementary seconds counter 68 and memory 69. Thus the explanations which have been given hereinabove in connection with FIG. 4 are valid by analogy for FIG. 7.

In FIG. 7 and in the case of a start signal, the seconds counter 68 and that of minutes 67 are incremented and the motors 42 and 43 drive the large hand S2 and the first small hand m respectively. In parallel thereto, the input management block effects the transformations S2←Q and m←BISS by line 85 and maintains in memory the day and the four-year cycle connected with timekeeping. The transformation h←Mo takes place as in FIG. 4. In the case of a reset to zero signal, the counters for seconds 68, minutes 67 and hours 66 are reset to zero. In parallel thereto, motors 42, 43 and 44 are switched onto memories 71, 69, 70 respectively, which brings about the transformations S2→ Q, m→BISS and h→Mo.

The micro-controller which is here used is of the same type OKI 5052 as that mentioned hereinabove. Programming however is slightly different since there is here added the four-year leap year cycle.

What we claim is:

1. A chronograph watch comprising time keeping indicators used for displaying the time of day, analog chronograph indicators comprising chronograph hands which are normally used for displaying a time interval, and a manual control arrangement for starting, stopping and resetting to zero said chronograph hands, said chronograph watch including instantaneous conversion means for automatically converting at least one of said chronograph hands into an indicator of a function other than the chronograph function whenever the chronograph is not in use.

2. A chronograph watch as set forth in claim 1, wherein the chronograph indicators comprise at least first and second chronograph small hands for counting minutes and hours, respectively, one of these chronograph small hands being driven by the instantaneous conversion means for constituting said indicator of a function other than the chronograph function whenever the chronograph is not in use.

3. A chronograph watch as set forth in claim 2, wherein said first chronograph small hand for counting minutes indicates the date whenever the chronograph is not in use.

4. A chronograph watch as set forth in claim 3, wherein said second chronograph small hand for counting hours indicates the month whenever the chronograph is not in use.

5. A chronograph watch as set forth in claim 4, including first and second memories adapted to memorize respectively the date and the month when the chronograph is started then stopped, the contents of said first and second memories being displayed by said first and second small hands respectively when the chronograph is reset to zero.

6. A chronograph watch as set forth in claim 1, wherein the chronograph indicators comprise at least a chronograph large hand for counting seconds, this large hand being driven by the instantaneous conversion means for constituting said indicator of a function other than the chronograph function whenever the chronograph is not in use.

7. A chronograph watch as set forth in claim 6, wherein said other function indicated by the chronograph large hand is the date.

8. A chronograph watch as set forth in claim 7, wherein the chronograph indicators further comprise a first small hand for counting minutes, which indicates the four-year leap year cycle whenever the chronograph is not in use, and second small hand for counting hours, which indicates the month also whenever the chronograph is not in use.

9. A chronograph watch as set forth in claim 8, including first, second and third memories adapted to memorise, respectively, the date, the four-year cycle and the month when the chronograph is started then stopped, the content of said first, second and third memory being displayed, respectively, by said large hand and said first and second small hands when the chronograph is reset to zero.

10. A chronograph watch as set forth in claim 1, wherein said time keeping indicators comprise at least an hours hand and a minutes hand and said chronograph indicators comprise a large hand for counting seconds, a first small hand for counting minutes and second small hand for counting hours.

11. A chronograph watch as set forth in claim 6, wherein said hours hand and minutes hand are driven by a first motor and said large hand, said first small hand and said second small hand are respectively driven by second, third and fourth motors.

* * * * *